US009101174B2

(12) United States Patent
Waters

(10) Patent No.: US 9,101,174 B2
(45) Date of Patent: Aug. 11, 2015

(54) HAT WITH AUTOMATED SHUT-OFF FEATURE FOR ELECTRICAL DEVICES

(71) Applicant: Michael Waters, Aspen, CO (US)

(72) Inventor: Michael Waters, Aspen, CO (US)

( * ) Notice: Subject to any disclaimer, the term of this patent is extended or adjusted under 35 U.S.C. 154(b) by 453 days.

(21) Appl. No.: 13/669,115

(22) Filed: Nov. 5, 2012

(65) Prior Publication Data

US 2013/0111651 A1 May 9, 2013

Related U.S. Application Data

(60) Provisional application No. 61/555,547, filed on Nov. 4, 2011.

(51) Int. Cl.

| | |
|---|---|
| ***A42B 1/00*** | (2006.01) |
| ***A42B 1/18*** | (2006.01) |
| ***A42B 1/24*** | (2006.01) |

(52) U.S. Cl.

CPC . *A42B 1/004* (2013.01); *A42B 1/18* (2013.01); *A42B 1/242* (2013.01)

(58) Field of Classification Search

CPC ..... A42B 1/004; A42B 1/18; A42B 1/242
USPC ..... 2/209.13; 362/105, 106
See application file for complete search history.

(56) References Cited

U.S. PATENT DOCUMENTS

| | | | |
|---|---|---|---|
| 645,984 | A | 3/1900 | Tournier |
| 909,742 | A | 1/1909 | Borchert |
| 1,098,628 | A | 6/1914 | Hyman |
| 1,109,415 | A | 9/1914 | Harris |
| 1,255,265 | A | 2/1918 | Zachara |
| 1,323,822 | A | 12/1919 | Bramming |
| 1,572,210 | A | 2/1926 | Kolibas |
| 1,744,777 | A | 1/1930 | Lundgren |

(Continued)

FOREIGN PATENT DOCUMENTS

| | | |
|---|---|---|
| AU | 11785/76 | 9/1977 |
| AU | 63109/94 | 11/1994 |

(Continued)

OTHER PUBLICATIONS

Docket report of *Waters Industries, Inc.* v. *Totes Isotoner Corporation, et al.*, United States District Court for the Northern District of Illinois, Case No. 1:10-cv-04487 filed Jul. 19, 2010 (4 pages).

(Continued)

*Primary Examiner* — Stephen F Husar
(74) *Attorney, Agent, or Firm* — Fitch, Even, Tabin & Flannery LLP

(57) ABSTRACT

Headgear is provided having one or more electrical devices, such as light sources mounted thereto. The headgear includes a power source for providing power to the electrical devices and a motion sensing device, such that any operating electrical devices are shut off if the hat does not move within a predetermined time period to conserve the life of the power source. In one form, the motion sensing device is operable to reset a shut-off timer when movement of the headgear is detected by the motion sensor so that the light sources, for example, are not turned off when the headgear is worn with the light sources turned on. In this manner, the shut-off timer is constantly being reset when the headgear is worn to keep the shut-off timer from timing out and turning the light sources off.

20 Claims, 11 Drawing Sheets

(56) References Cited

U.S. PATENT DOCUMENTS

| | | | | |
|---|---|---|---|---|
| 1,749,998 | A | | 3/1930 | Collins |
| D137,375 | S | | 2/1944 | Heit |
| 2,369,829 | A | | 2/1945 | Johnson |
| 2,373,553 | A | | 4/1945 | Fetterman |
| 2,461,254 | A | | 2/1949 | Bassett |
| 2,473,394 | A | | 6/1949 | Scott |
| 2,540,435 | A | | 2/1951 | Ferguson |
| 2,552,764 | A | | 5/1951 | Bedford, Jr. |
| 2,638,532 | A | | 5/1953 | Brady |
| 2,640,980 | A | | 6/1953 | Prupis |
| 2,705,751 | A | | 4/1955 | Harris et al. |
| 2,788,439 | A | | 4/1957 | Hesse |
| 2,904,670 | A | | 9/1959 | Calmes |
| 2,978,696 | A | | 4/1961 | Keller et al. |
| 3,008,040 | A | | 11/1961 | Moore |
| 3,032,647 | A | | 5/1962 | Wansky et al. |
| 3,040,881 | A | | 6/1962 | McNeil |
| 3,057,992 | A | | 10/1962 | Baker |
| 3,060,308 | A | | 10/1962 | Fortuna |
| 3,123,208 | A | | 3/1964 | Barnum et al. |
| 3,184,058 | A | | 5/1965 | Crowther |
| 3,201,771 | A | | 8/1965 | Proulx |
| 3,350,552 | A | | 10/1967 | Lawrence |
| 3,358,137 | A | | 12/1967 | Sinclair et al. |
| 3,491,374 | A | | 1/1970 | Frangos |
| 3,537,909 | A | | 11/1970 | Horton |
| 3,602,759 | A | | 8/1971 | Evans et al. |
| 3,666,901 | A | | 5/1972 | Weinhart |
| 3,749,902 | A | | 7/1973 | Drew |
| 3,845,389 | A | | 10/1974 | Phillips et al. |
| 3,947,676 | A | | 3/1976 | Battilana et al. |
| 3,963,917 | A | | 6/1976 | Romano |
| 4,005,776 | A | | 2/1977 | Seeley |
| 4,011,600 | A | | 3/1977 | Malk |
| 4,053,688 | A | | 10/1977 | Perkins et al. |
| 4,092,704 | A | * | 5/1978 | Malm ..... 362/106 |
| 4,186,429 | A | | 1/1980 | Johnston |
| 4,210,952 | A | | 7/1980 | Ressmeyer |
| 4,231,079 | A | | 10/1980 | Heminover |
| 4,268,894 | A | | 5/1981 | Bartunek et al. |
| 4,283,127 | A | | 8/1981 | Rosenwinkel et al. |
| 4,298,913 | A | | 11/1981 | Lozar |
| 4,364,107 | A | | 12/1982 | Wieczorek et al. |
| 4,398,237 | A | | 8/1983 | Doyel |
| 4,406,040 | A | | 9/1983 | Cannone |
| D272,733 | S | | 2/1984 | Cosmos et al. |
| 4,442,478 | A | | 4/1984 | Stansbury |
| 4,462,064 | A | | 7/1984 | Schweitzer |
| 4,470,263 | A | | 9/1984 | Lehovec et al. |
| 4,483,021 | A | | 11/1984 | McCall |
| 4,516,157 | A | | 5/1985 | Campbell |
| 4,521,831 | A | | 6/1985 | Thayer |
| 4,541,698 | A | | 9/1985 | Lerner |
| 4,551,857 | A | | 11/1985 | Galvin |
| 4,559,516 | A | | 12/1985 | Schott et al. |
| 4,570,206 | A | | 2/1986 | Deutsch |
| 4,602,191 | A | | 7/1986 | Davila |
| 4,604,760 | A | | 8/1986 | Coin |
| 4,638,410 | A | | 1/1987 | Barker |
| 4,642,817 | A | | 2/1987 | Ferstenfeld |
| 4,665,568 | A | | 5/1987 | Stutes |
| 4,669,610 | A | | 6/1987 | Lindsey et al. |
| 4,680,815 | A | | 7/1987 | Hirsch et al. |
| 4,794,496 | A | | 12/1988 | Lanes et al. |
| 4,817,212 | A | | 4/1989 | Benoit |
| 4,827,384 | A | | 5/1989 | Von Schlemmer |
| 4,872,218 | A | | 10/1989 | Holt |
| 4,901,210 | A | | 2/1990 | Hanabusa |
| 4,901,211 | A | | 2/1990 | Shen |
| 4,951,068 | A | | 8/1990 | Ichikawa et al. |
| 4,959,760 | A | | 9/1990 | Wu |
| 4,963,045 | A | | 10/1990 | Willcox |
| 4,991,068 | A | | 2/1991 | Mickey |
| 4,998,187 | A | | 3/1991 | Herrick |
| D316,932 | S | | 5/1991 | Escher, Jr. |
| 5,039,829 | A | | 8/1991 | Brucksch |
| 5,060,814 | A | | 10/1991 | Oglesbee |
| 5,068,771 | A | | 11/1991 | Savage, Jr. |
| 5,070,436 | A | | 12/1991 | Alexander et al. |
| 5,088,127 | A | | 2/1992 | Thornock |
| 5,111,366 | A | | 5/1992 | Rife et al. |
| 5,113,325 | A | | 5/1992 | Eisenbraun |
| 5,122,943 | A | | 6/1992 | Pugh |
| 5,140,116 | A | | 8/1992 | Schmitt-Walter |
| 5,140,220 | A | | 8/1992 | Hasegawa |
| 5,143,443 | A | | 9/1992 | Madsen |
| 5,163,420 | A | | 11/1992 | Van Der Bel |
| 5,165,789 | A | | 11/1992 | Womack |
| 5,189,512 | A | | 2/1993 | Cameron et al. |
| 5,193,220 | A | | 3/1993 | Ichinohe et al. |
| 5,193,347 | A | | 3/1993 | Apisdorm |
| 5,218,385 | A | | 6/1993 | Lii |
| 5,224,772 | A | | 7/1993 | Fustos |
| 5,230,558 | A | | 7/1993 | Jong |
| 5,238,344 | A | | 8/1993 | Nagayama |
| 5,245,516 | A | | 9/1993 | de Haas et al. |
| 5,249,675 | A | | 10/1993 | Strauss et al. |
| 5,278,734 | A | | 1/1994 | Ferber |
| D349,123 | S | | 7/1994 | Cooley et al. |
| 5,329,637 | A | | 7/1994 | Walker |
| 5,331,333 | A | | 7/1994 | Tagawa et al. |
| 5,331,357 | A | | 7/1994 | Cooley et al. |
| 5,357,409 | A | | 10/1994 | Glatt |
| 5,363,291 | A | | 11/1994 | Steiner |
| 5,404,593 | A | | 4/1995 | Kronenberger |
| 5,408,393 | A | | 4/1995 | Becker |
| 5,410,746 | A | | 4/1995 | Gelber |
| 5,412,545 | A | | 5/1995 | Rising |
| 5,418,565 | A | | 5/1995 | Smith |
| 5,423,419 | A | | 6/1995 | Wentz et al. |
| 5,438,698 | A | | 8/1995 | Burton et al. |
| 5,452,190 | A | | 9/1995 | Priesemuth |
| 5,460,346 | A | | 10/1995 | Hirsch |
| 5,463,538 | A | | 10/1995 | Womack |
| 5,467,992 | A | | 11/1995 | Harkness |
| 5,485,358 | A | | 1/1996 | Chien |
| 5,503,637 | A | | 4/1996 | Kyricos et al. |
| 5,508,900 | A | | 4/1996 | Norman |
| 5,510,961 | A | | 4/1996 | Peng |
| 5,541,767 | A | | 7/1996 | Murphy et al. |
| 5,541,816 | A | | 7/1996 | Miserendino |
| 5,542,627 | A | | 8/1996 | Crenshaw et al. |
| 5,546,099 | A | | 8/1996 | Quint et al. |
| 5,564,128 | A | | 10/1996 | Richardson |
| 5,567,038 | A | | 10/1996 | Lary |
| 5,575,554 | A | | 11/1996 | Guritz |
| 5,610,678 | A | | 3/1997 | Tsuboi et al. |
| 5,644,189 | A | | 7/1997 | Busby |
| 5,655,374 | A | | 8/1997 | Santilli |
| 5,667,291 | A | | 9/1997 | Caplan et al. |
| 5,667,292 | A | | 9/1997 | Sabalvaro, Jr. |
| 5,676,449 | A | | 10/1997 | Newsome |
| 5,677,079 | A | | 10/1997 | DeZorzi |
| 5,680,718 | A | | 10/1997 | Ratcliffe et al. |
| 5,688,039 | A | | 11/1997 | Johnson |
| 5,692,244 | A | | 12/1997 | Johnson et al. |
| 5,708,449 | A | | 1/1998 | Heacock et al. |
| 5,718,335 | A | | 2/1998 | Boudreaux |
| 5,722,762 | A | | 3/1998 | Soll |
| 5,730,290 | A | | 3/1998 | Futo |
| 5,741,060 | A | | 4/1998 | Johnson |
| 5,743,621 | A | | 4/1998 | Mantha et al. |
| 5,758,947 | A | | 6/1998 | Glatt |
| 5,786,665 | A | | 7/1998 | Ohtsuki et al. |
| 5,800,278 | A | | 9/1998 | Varriano |
| 5,822,636 | A | | 10/1998 | Cho |
| 5,829,063 | A | | 11/1998 | Cheng |
| 5,836,673 | A | | 11/1998 | Lo |
| 5,845,778 | A | | 12/1998 | Hickey, Jr. |
| 5,845,987 | A | | 12/1998 | Painter |
| 5,857,220 | A | | 1/1999 | Erny et al. |
| 5,865,333 | A | | 2/1999 | Wolfe |
| 5,871,271 | A | | 2/1999 | Chien |
| D407,187 | S | | 3/1999 | Makki |

(56) References Cited

U.S. PATENT DOCUMENTS

| | | | |
|---|---|---|---|
| 5,876,241 | A | 3/1999 | Frantz |
| 5,894,604 | A | 4/1999 | Crabb et al. |
| 5,918,966 | A | 7/1999 | Arnold |
| 5,920,910 | A | 7/1999 | Calvo |
| 5,921,674 | A | 7/1999 | Koczi |
| 5,922,489 | A | 7/1999 | Adachi |
| 5,931,693 | A | 8/1999 | Yamazaki |
| 5,946,071 | A | 8/1999 | Feldman |
| 5,982,969 | A | 11/1999 | Sugiyama et al. |
| 5,997,165 | A | 12/1999 | Lehrer |
| 6,005,536 | A | 12/1999 | Beadles et al. |
| 6,007,212 | A | 12/1999 | Chan |
| 6,007,213 | A | 12/1999 | Baumgartner |
| 6,009,563 | A | 1/2000 | Swanson et al. |
| 6,012,822 | A | 1/2000 | Robinson |
| 6,012,827 | A | 1/2000 | Caplan et al. |
| 6,021,525 | A | 2/2000 | Mertins |
| 6,023,788 | A | 2/2000 | McCallum et al. |
| 6,028,627 | A | 2/2000 | Helmsderfer |
| 6,032,291 | A | 3/2000 | Asenguah et al. |
| 6,032,293 | A | 3/2000 | Makki |
| 6,056,413 | A | 5/2000 | Urso |
| D428,431 | S | 7/2000 | Jordan |
| 6,086,214 | A | 7/2000 | Ridge |
| 6,087,037 | A | 7/2000 | Rieder |
| 6,088,053 | A | 7/2000 | Hammack et al. |
| 6,094,749 | A | 8/2000 | Proctor |
| 6,113,243 | A | 9/2000 | Saul |
| 6,113,244 | A | 9/2000 | Baumgartner |
| 6,116,745 | A | 9/2000 | Yei |
| 6,124,056 | A | 9/2000 | Kimura |
| 6,126,294 | A | 10/2000 | Koyama et al. |
| 6,167,570 | B1 | 1/2001 | Su |
| 6,168,286 | B1 | 1/2001 | Duffy |
| 6,172,657 | B1 | 1/2001 | Kamakura et al. |
| 6,174,075 | B1 | 1/2001 | Fuwausa |
| 6,206,543 | B1 | 3/2001 | Henry |
| 6,236,007 | B1 | 5/2001 | Ho |
| 6,237,147 | B1 | 5/2001 | Brockman |
| 6,240,566 | B1 | 6/2001 | Scantlin |
| 6,244,721 | B1 | 6/2001 | Rodriguez et al. |
| 6,250,769 | B1 | 6/2001 | Kirk |
| 6,256,795 | B1 | 7/2001 | Habel |
| 6,290,368 | B1 | 9/2001 | Lehrer |
| 6,306,538 | B1 | 10/2001 | Saitoh et al. |
| 6,307,526 | B1 | 10/2001 | Mann |
| 6,311,837 | B1 | 11/2001 | Blaustein et al. |
| 6,320,822 | B1 | 11/2001 | Okeya et al. |
| 6,325,521 | B1 | 12/2001 | Gregg et al. |
| 6,328,454 | B1 | 12/2001 | Davis |
| 6,340,234 | B1 | 1/2002 | Brown, Jr. |
| 6,345,716 | B1 | 2/2002 | Chapman |
| 6,347,410 | B1 | 2/2002 | Lee |
| 6,363,537 | B1 | 4/2002 | Park |
| 6,366,344 | B1 | 4/2002 | Lach |
| 6,382,407 | B1 | 5/2002 | Chao |
| 6,386,701 | B1 | 5/2002 | Khulusi |
| 6,390,640 | B1 | 5/2002 | Wong et al. |
| 6,398,386 | B1 | 6/2002 | Huang |
| 6,416,199 | B1 | 7/2002 | Heine |
| 6,431,904 | B1 | 8/2002 | Berelsman |
| 6,442,764 | B1 | 9/2002 | Badillo et al. |
| 6,457,838 | B1 | 10/2002 | Dugmore et al. |
| 6,461,015 | B1 | 10/2002 | Welch |
| 6,461,025 | B1 | 10/2002 | Payne |
| 6,474,830 | B1 | 11/2002 | Hansen |
| 6,497,493 | B1 | 12/2002 | Theisen |
| 6,504,099 | B2 | 1/2003 | Huang |
| 6,549,231 | B1 | 4/2003 | Matsui |
| 6,553,570 | B1 | 4/2003 | Flynn |
| 6,578,982 | B1 | 6/2003 | Lynch |
| 6,598,991 | B2 | 7/2003 | Altman |
| 6,604,837 | B2 | 8/2003 | Sandberg |
| 6,616,293 | B2 | 9/2003 | Mickey |
| 6,659,618 | B2 | 12/2003 | Waters |
| 6,679,615 | B2 | 1/2004 | Spearing |
| 6,704,044 | B1 | 3/2004 | Foster et al. |
| 6,709,142 | B2 | 3/2004 | Gyori |
| 6,713,956 | B2 | 3/2004 | Chen et al. |
| 6,715,309 | B1 | 4/2004 | Junkins |
| 6,719,437 | B2 | 4/2004 | Lary et al. |
| 6,721,962 | B1 | 4/2004 | Polaire |
| D489,165 | S | 5/2004 | Waters |
| 6,733,150 | B1 | 5/2004 | Hanley |
| 6,760,925 | B1 | 7/2004 | Maxwell |
| 6,764,194 | B1 | 7/2004 | Cooper |
| 6,802,636 | B1 | 10/2004 | Bailey, Jr. |
| 6,811,441 | B2 | 11/2004 | Simpson |
| 6,817,711 | B2 | 11/2004 | Schubert |
| 6,830,357 | B2 | 12/2004 | Lopez |
| 6,837,590 | B2 | 1/2005 | Marston |
| 6,860,628 | B2 | 3/2005 | Robertson et al. |
| 6,865,285 | B1 | 3/2005 | Villa-Aleman |
| 6,908,208 | B1 | 6/2005 | Hyde et al. |
| 6,923,322 | B2 | 8/2005 | Lenker |
| 6,932,216 | B2 | 8/2005 | Blaustein et al. |
| 6,935,761 | B2 | 8/2005 | Vanderschuit |
| 6,941,583 | B2 | 9/2005 | Yan |
| 6,966,668 | B2 | 11/2005 | Cugini et al. |
| 6,969,178 | B2 | 11/2005 | Zuloff |
| 6,977,776 | B2 | 12/2005 | Volkenandt et al. |
| 6,993,803 | B2 | 2/2006 | Chan |
| 6,994,445 | B1 | 2/2006 | Pomes |
| 7,000,841 | B2 | 2/2006 | Becker |
| 7,003,353 | B1 | 2/2006 | Parkhouse |
| 7,004,439 | B1 | 2/2006 | Taylor et al. |
| 7,021,790 | B2 | 4/2006 | Parsons |
| D520,460 | S | 5/2006 | Wadsworth et al. |
| 7,052,154 | B2 | 5/2006 | Vanderschuit |
| 7,086,749 | B1 | 8/2006 | Hanley |
| 7,094,981 | B2 | 8/2006 | Sorrentino et al. |
| 7,105,939 | B2 | 9/2006 | Bednyak |
| 7,111,956 | B2 | 9/2006 | Brown |
| 7,118,241 | B2 | 10/2006 | Sohn |
| 7,118,262 | B2 | 10/2006 | Negley |
| 7,128,434 | B1 | 10/2006 | Nally et al. |
| 7,147,338 | B2 | 12/2006 | Gregg |
| 7,163,309 | B2 | 1/2007 | Sohn |
| 7,182,478 | B2 | 2/2007 | Marston |
| 7,186,159 | B1 | 3/2007 | Baxter |
| 7,192,151 | B2 | 3/2007 | Clupper et al. |
| 7,234,831 | B1 | 6/2007 | Hanley |
| D566,044 | S | 4/2008 | D'Arco et al. |
| 7,369,174 | B2 | 5/2008 | Olita et al. |
| 7,427,149 | B2 | 9/2008 | Sohn |
| 7,431,472 | B2 | 10/2008 | Becker |
| 7,461,764 | B2 | 12/2008 | Thompson |
| 7,470,022 | B2 | 12/2008 | Lerner |
| 7,506,992 | B2 | 3/2009 | Carter |
| D591,675 | S | 5/2009 | Waters |
| 7,576,800 | B2 | 8/2009 | Swain |
| D600,208 | S | 9/2009 | Waters |
| 7,598,928 | B1 | 10/2009 | Buskop |
| 7,609,295 | B2 | 10/2009 | Aridome et al. |
| 7,611,255 | B1 | 11/2009 | Lagassey |
| 7,621,000 | B1 | 11/2009 | Fulton |
| 7,661,818 | B2 | 2/2010 | Waters |
| 7,677,751 | B2 | 3/2010 | Kinsman et al. |
| 7,753,547 | B2 | 7/2010 | Waters |
| 7,784,960 | B2 | 8/2010 | Lahtinen |
| 8,333,485 | B2 | 12/2012 | Waters |
| 8,388,164 | B2 | 3/2013 | Waters |
| 8,491,145 | B2 | 7/2013 | Waters |
| 2001/0024365 | A1 | 9/2001 | Aknine |
| 2002/0131275 | A1 | 9/2002 | Yamamoto et al. |
| 2002/0159250 | A1 | 10/2002 | Kuo et al. |
| 2002/0163800 | A1 | 11/2002 | Hansen |
| 2002/0186557 | A1 | 12/2002 | Lary et al. |
| 2002/0187806 | A1 | 12/2002 | Jang |
| 2003/0079387 | A1 | 5/2003 | Derose |
| 2003/0106918 | A1 | 6/2003 | Hung |
| 2003/0122958 | A1 | 7/2003 | Olita et al. |
| 2003/0151910 | A1 | 8/2003 | Marston |
| 2003/0169207 | A1 | 9/2003 | Beigel |

(56) References Cited

U.S. PATENT DOCUMENTS

| | | | |
|---|---|---|---|
| 2003/0231489 | A1 | 12/2003 | Hsiao |
| 2004/0008157 | A1 | 1/2004 | Brubaker et al. |
| 2004/0141312 | A1 | 7/2004 | Henning et al. |
| 2004/0165109 | A1 | 8/2004 | Lee |
| 2004/0222638 | A1 | 11/2004 | Bednyak |
| 2004/0240067 | A1 | 12/2004 | Marusi et al. |
| 2004/0240204 | A1 | 12/2004 | Russ et al. |
| 2004/0264176 | A1 | 12/2004 | Vanderschuit |
| 2005/0001433 | A1 | 1/2005 | Seelin |
| 2005/0047116 | A1 | 3/2005 | Gagne |
| 2005/0066422 | A1 | 3/2005 | Yan |
| 2005/0072458 | A1 | 4/2005 | Goldstein |
| 2005/0078473 | A1 | 4/2005 | Zuloff |
| 2005/0083676 | A1 | 4/2005 | VanderSchuit |
| 2005/0099799 | A1 | 5/2005 | Cugini et al. |
| 2005/0105285 | A1 | 5/2005 | Maden |
| 2005/0161313 | A1 | 7/2005 | Sorrentino et al. |
| 2005/0174753 | A1 | 8/2005 | Cao et al. |
| 2005/0204490 | A1 | 9/2005 | Kemp et al. |
| 2005/0211187 | A1 | 9/2005 | Harman et al. |
| 2005/0211574 | A1 | 9/2005 | Reeve |
| 2005/0213340 | A1 | 9/2005 | Suzuki et al. |
| 2005/0219837 | A1 | 10/2005 | Brown |
| 2005/0265015 | A1 | 12/2005 | Salazar |
| 2006/0037125 | A1 | 2/2006 | McDowell |
| 2006/0091784 | A1 | 5/2006 | Conner et al. |
| 2006/0092621 | A1 | 5/2006 | Lai |
| 2006/0107952 | A1 | 5/2006 | Schlosser |
| 2006/0125624 | A1 | 6/2006 | Ostrovsky et al. |
| 2006/0126323 | A1 | 6/2006 | Pomes |
| 2006/0138440 | A1 | 6/2006 | Jyo |
| 2006/0141828 | A1 | 6/2006 | Dean et al. |
| 2006/0157569 | A1 | 7/2006 | Becker |
| 2006/0158895 | A1 | 7/2006 | Brands et al. |
| 2006/0165160 | A1 | 7/2006 | Winningstad et al. |
| 2006/0198122 | A1 | 9/2006 | Senter et al. |
| 2006/0215393 | A1 | 9/2006 | VanderSchuit |
| 2006/0232955 | A1 | 10/2006 | Labine |
| 2006/0239018 | A1 | 10/2006 | Jardin |
| 2006/0263677 | A1 | 11/2006 | Tsai |
| 2006/0285315 | A1 | 12/2006 | Tufenkjian |
| 2006/0286443 | A1 | 12/2006 | Huang |
| 2006/0291193 | A1 | 12/2006 | Hill |
| 2007/0003826 | A1 | 1/2007 | Hsu |
| 2007/0048598 | A1 | 3/2007 | Huang |
| 2007/0053179 | A1 | 3/2007 | Pang et al. |
| 2007/0058361 | A1 | 3/2007 | Sevilla |
| 2007/0064413 | A1 | 3/2007 | Slater |
| 2007/0072655 | A1 | 3/2007 | Cascone |
| 2007/0074752 | A1 | 4/2007 | Shau et al. |
| 2007/0097668 | A1 | 5/2007 | Choi |
| 2007/0140675 | A1 | 6/2007 | Yanagi |
| 2007/0145746 | A1 | 6/2007 | Biamonte |
| 2007/0153537 | A1 | 7/2007 | Scott et al. |
| 2007/0159810 | A1 | 7/2007 | Kim |
| 2007/0159823 | A1 | 7/2007 | Ho et al. |
| 2007/0171628 | A1 | 7/2007 | Seade |
| 2007/0189003 | A1 | 8/2007 | Daley |
| 2007/0206373 | A1 | 9/2007 | Whiteside et al. |
| 2007/0236915 | A1 | 10/2007 | Chen |
| 2007/0236916 | A1 | 10/2007 | Hsu |
| 2008/0130272 | A1 | 6/2008 | Waters |
| 2008/0263750 | A1 | 10/2008 | Chen et al. |
| 2008/0266839 | A1 | 10/2008 | Claypool et al. |
| 2009/0147503 | A1 | 6/2009 | Bennett |
| 2009/0148149 | A1 | 6/2009 | Chishima |
| 2009/0193566 | A1 | 8/2009 | Waters |
| 2010/0214767 | A1 | 8/2010 | Waters |
| 2010/0307931 | A1 | 12/2010 | Waters |
| 2010/0313335 | A1 | 12/2010 | Waters |
| 2011/0122601 | A1 | 5/2011 | Waters |
| 2011/0210685 | A1 | 9/2011 | Liao |
| 2012/0014095 | A2 | 1/2012 | Waters |

FOREIGN PATENT DOCUMENTS

| | | | |
|---|---|---|---|
| AU | 199940150 | | 2/2000 |
| AU | 199959545 | | 3/2000 |
| AU | 2002100976 | | 6/2003 |
| AU | 2003100277 | | 7/2003 |
| AU | 2003248016 | | 11/2004 |
| CA | 2029772 | | 5/1991 |
| CA | 2198625 | | 2/1997 |
| CA | 2184336 | | 5/1997 |
| CA | 2406450 | | 11/2001 |
| CA | 2466175 | | 5/2003 |
| CN | 86208973 | | 10/1987 |
| CN | 2173427 | | 8/1994 |
| CN | 2239167 | | 11/1996 |
| CN | 2423761 | | 3/2001 |
| CN | 2433836 | | 6/2001 |
| CN | 2458892 | | 11/2001 |
| CN | 2508592 | | 9/2002 |
| CN | 2544551 | | 4/2003 |
| CN | 1462597 | | 12/2003 |
| CN | 1603677 | | 4/2005 |
| DE | 8230583 | | 9/1983 |
| DE | 29808222 | | 11/1998 |
| DE | 19837151 | | 4/2000 |
| DE | 20007738 | | 9/2000 |
| DE | 29915607 | | 9/2000 |
| DE | 20017922 | | 2/2001 |
| DE | 20020515 | | 8/2001 |
| DE | 20101380 | | 8/2001 |
| DE | 20106261 | | 9/2001 |
| DE | 20111815 | | 11/2001 |
| DE | 10046295 | | 3/2002 |
| DE | 20117740 | | 4/2002 |
| DE | 20201557 | | 5/2002 |
| DE | 20200058 | | 6/2002 |
| DE | 10103591 | | 8/2002 |
| DE | 20110124 | | 8/2002 |
| DE | 10057388 | | 9/2002 |
| DE | 20209115 | | 10/2002 |
| DE | 20210806 | | 10/2002 |
| DE | 10216152 | | 12/2002 |
| DE | 20209611 | | 1/2003 |
| DE | 20313629 | | 12/2003 |
| DE | 10330589 | | 1/2004 |
| DE | 20319297 | | 2/2004 |
| DE | 20318860 | | 4/2004 |
| DE | 20318949 | | 4/2004 |
| DE | 202004004960 | | 9/2005 |
| DE | 10 2007 006 860 | A1 | 8/2007 |
| EP | 1072204 | | 1/2001 |
| EP | 1374707 | | 1/2004 |
| FR | 1221782 | | 6/1960 |
| FR | 2798721 | | 3/2001 |
| FR | 2824709 | | 11/2002 |
| FR | 2829365 | | 3/2003 |
| FR | 2833068 | | 6/2003 |
| FR | 2833069 | | 6/2003 |
| GB | 2268043 | | 1/1994 |
| GB | 2316293 | | 2/1998 |
| GB | 2358575 | | 8/2001 |
| GB | 2363314 | | 12/2001 |
| GB | 2374401 | | 10/2002 |
| GB | 2378117 | | 2/2003 |
| GB | 2378118 | | 2/2003 |
| GB | 2388298 | | 11/2003 |
| JP | S61-006304 | | 1/1986 |
| JP | 4289602 | | 10/1992 |
| JP | H08-027610 | A | 1/1996 |
| JP | H08-298004 | A | 11/1996 |
| JP | H09-209210 | A | 8/1997 |
| JP | H09-296319 | A | 11/1997 |
| JP | H10-081275 | A | 3/1998 |
| JP | H10-331019 | A | 12/1998 |
| JP | 3084061 | | 11/2001 |
| JP | 2004-207580 | | 7/2004 |
| JP | 2005-216832 | A | 8/2005 |
| JP | 2006-097156 | A | 4/2006 |
| KR | 20-0164075 | | 2/2000 |

(56) References Cited

FOREIGN PATENT DOCUMENTS

| | | |
|---|---|---|
| KR | 200168826 | 2/2000 |
| KR | 200260980 | 1/2002 |
| KR | 20020065405 | 8/2002 |
| KR | 200331201 | 10/2003 |
| TW | 241462 | 2/1995 |
| TW | 275188 | 5/1996 |
| TW | 286489 | 9/1996 |
| TW | 324234 | 1/1998 |
| TW | 329607 | 4/1998 |
| TW | 386364 | 4/2000 |
| WO | 94/02043 | 2/1994 |
| WO | 97/04434 | 2/1997 |
| WO | 02/44611 | 6/2002 |
| WO | 02/062165 | 8/2002 |
| WO | 02/074398 | 9/2002 |
| WO | 02/077520 | 10/2002 |
| WO | 03/040808 | 5/2003 |
| WO | 03/047377 | 6/2003 |
| WO | 03/083811 | 10/2003 |
| WO | 04/000054 | 12/2003 |
| WO | 2004/064555 | 5/2004 |
| WO | 2004/103104 | 12/2004 |
| WO | 2005/002378 | 1/2005 |
| WO | 2005/005882 | 1/2005 |
| WO | 2005/038337 | 4/2005 |
| WO | 2005/096856 | 10/2005 |
| WO | 2005/098314 | 10/2005 |
| WO | 2006/037845 | 4/2006 |
| WO | 2006/124928 | 11/2006 |
| WO | 2007/073047 | 6/2007 |
| WO | 2007/073219 | 6/2007 |
| WO | 2007/089236 | 8/2007 |
| WO | 2007/093348 | 8/2007 |
| WO | 2007/112338 | 10/2007 |
| WO | 2008/011750 | 1/2008 |
| WO | 2009/079656 | 6/2009 |
| WO | 2010/099504 | 9/2010 |
| WO | 2011/137400 | 11/2011 |
| WO | 2011/137406 | 11/2011 |
| WO | 2013/096895 | 6/2013 |
| WO | 2013/096904 | 6/2013 |

OTHER PUBLICATIONS

"Complaint", *Waters Industries, Inc*. v. *Totes Isotoner Corporation, et al*., United States District Court for the Northern District of Illinois, Case No. 1:10-cv-04487 (26 pages).

* cited by examiner

HAT WITH AUTOMATED SHUT-OFF FEATURE FOR ELECTRICAL DEVICES

CROSS REFERENCE TO RELATED APPLICATION

This patent claims benefit under 35 U.S.C. §119 (e) to U.S. Provisional Application No. 61/555,547 entitled "Hat with Automated Shut-Off Feature for Electrical Devices" filed Nov. 4, 2011, having attorney docket number 7122-99630-US, the contents of which are incorporated herein by reference in its entirety.

FIELD OF THE INVENTION

The field relates to hands-free lighting devices and, in particular, to lighted hats, lighted clothing items, and other accessories and components associated with hands-free lighting devices.

BACKGROUND OF THE INVENTION

Often an individual desires a light focused to illuminate an area while performing a task or a light directed in a general outward direction for visibility. Holding a flashlight is an option, but such lighting devices are often cumbersome and may detract from the task being completed because the flashlight needs to be hand-held to be able to direct the light at a work site where the user needs illumination. As a result, hands-free lighting such as lighted headgear is often used because the individual desiring illumination does not need to hold the light source.

The lighted headgear can be a lighted hat that is displayed on a store shelf in a manner so that a potential purchaser can operate an activation switch to turn on the light source. To this end, the hat may be provided to the store with a power source already included so that the light source can be activated by the consumer. However, because the lighted hat may be shipped in bulk to the store with the power source included, the power source can be unintentionally activated through contact of the activation switch with an adjacent one of the packed hats. In particular, where the activation switch is positioned on the hat brim, the light source can be inadvertently turned on during shipping by the hat brim of one hat engaging or depressing the activation switch of another hat nested therewith. Such inadvertent activation can drain the power source prior to the hat's display on the store shelf.

Prior packaging arrangements have been configured to allow actuation of a switch to momentarily activate a power source while an item is encased with the packaging, but such prior packaging is generally a blister-type pack that completely encases the product so that it tends to be bulky and distracts from the appearance of the item within the package. Moreover, such prior blister-pack arrangements generally do not include sufficient structure on the packaging to block inadvertent actuation of the switch that might cause power to drain from the battery.

Moreover, while such packaging might protect against inadvertent actuation, a user can still leave the light source activated after the user is finished using it. For example, a user testing the light source at a store can leave the hat on the shelf with the light source still activated. This undesirably drains the power source so that a subsequent user might not be able to test the light source or a subsequent purchaser has limited power source life.

SUMMARY OF THE INVENTION

In one form, headgear is provided, such as a hat, stocking cap, headband, or the like, having one or more electrical devices, such as light sources, camera devices, or the like, mounted thereto. The hat includes a power source for providing power to the electrical device(s) and a shut-off mechanism for deactivating any operating electrical device(s) if the hat is not being used or worn. The shut-off mechanism can include a sensor device for detecting whether the hat is being used or worn, such as a motion sensor. If the hat does not move within a predetermined time period, the shut-off mechanism will deactivate any operating electrical devices to conserve the life of the power source.

In one preferred form, the shut-off mechanism includes an on/off switch configured to cycle the electrical devices through "on" and "off" states as desired. The on/off switch is coupled to control circuitry, which can include a microprocessor, configured or programmed to initiate a timer upon activation of the electrical devices to the "on" state. The timer counts down a predetermined time period, such as five, ten, or fifteen minutes, at the end of which the control circuitry is programmed to deactivate the electrical device(s). While this advantageously preserves battery life when the electrical device(s) are inadvertently left in the "on" state, such a timer, without more, would also turn the electrical device(s) off whether or not the headgear is worn and the operation of the electrical device(s) is desired. As such, the automatic shut-off mechanism can further include a motion or inertia sensor, such as in the form of tilt or vibration switch device, electrically coupled to the control circuitry and other electrical hat components. The motion sensor is configured to produce signals with movement thereof, such as normal movement from wearing the headgear. These signals can be utilized to repeatedly reset the timer through the control circuitry so that the electrical device(s) continue to operate as long as the headgear is moved during the timed period.

The tilt switch device can include a conductive housing having one or more contacts conductively insulated from the housing exposed in the interior of the housing. The tilt switch further includes a conductive member, such as a ball, allowed to freely travel as by rolling or shifting within the housing interior. With movement of the tilt switch, the conductive ball can roll into contact with one of the contacts exposed in the housing interior, which electrically couples the housing with the contact. When such a tilt switch device is mounted to a hat brim, hat crown, head band, or light module, routine movement of a wearer's head will repeatedly cause the conductive ball to electrically couple and decouple the housing with the contact, which can advantageously be utilized to generate a timer reset signal to repeatedly reset the timer each time the ball rolls into engagement with the contact. As the conductive ball continues to move with movement of the person wearing the headgear or simply by movement of their head, the ball will repeatedly contact the contact exposed within the interior of the housing, generating multiple timer reset signals for resetting the timer to keep the electrical device(s) activated until such movement ceases, such as when the wearer removes the headgear from their head. When the timer runs out, any electrical devices in an "on" state are switched to an "off" state.

DETAILED DESCRIPTION OF THE PREFERRED EMBODIMENTS

In general, the various aspects of the invention herein relate to lights and other electronic devices that can be mounted to headgear and an automatic shut-off feature therefor. The headgear can include hats, including baseball caps, hoods, headbands, and other lighted clothing items having the lights positioned thereon to provide lighting generally forwardly of the wearer.

The headgear configured as described herein includes a mechanism to shut off one or more electronic devices operating on the headgear if a predetermined amount of time passes without movement of the headgear, such as by a wearer of the headgear moving from one location to another or by shifting their head. So configured, the shut-off mechanism allows the electronic devices to continue to operate as long as a user is wearing the headgear, but can also preserve power source life by turning off the electronic devices if a user leaves the hat in a fixed orientation, such as sitting on a stable surface with the electronic devices still operating.

More particularly, the headgear has the electronic devices and a power source to provide power to the electronic devices mounted thereto. An on/off switch can also be mounted to the headgear for allowing a user to selectively turn the electronic devices on and off. A motion or inertia sensor, such as in the form of a tilt or vibration switch mechanism, can be electronically coupled between the electronic devices and the power source. The sensor is electrically coupled to control circuitry and is operable to provide the circuit with signals indicating movement of the headgear and, thus, signals indicating that the headgear is being worn. The control circuit or circuitry includes a shut-off timer of a specified or predetermined time period that is actuated or started upon actuation of the on/off switch to turn the electronic devices on. With this configuration, when a user of the headgear activates one or more of the electronic devices, the control circuitry automatically starts the shut-off timer, which is set to run a predetermined length of time. If the timer runs the predetermined time without interruption and times out, the control circuitry is configured to turn any operating electronic devices off.

The motion or inertia sensor is actuated with movement of the headgear and, as such, can be configured to reset the shut-off timer upon actuation thereof. The motion sensor advantageously repeatedly resets the shut-off timer upon sufficiently continuous movement of the headgear by a wearer thereof. Importantly, however, if a user takes the headgear off and sets it down without turning the electronic devices off, the motion sensor will not be actuated and the shut-off timer will run down and the control circuitry will turn off the electronic devices to thereby save battery life.

Figure 1:
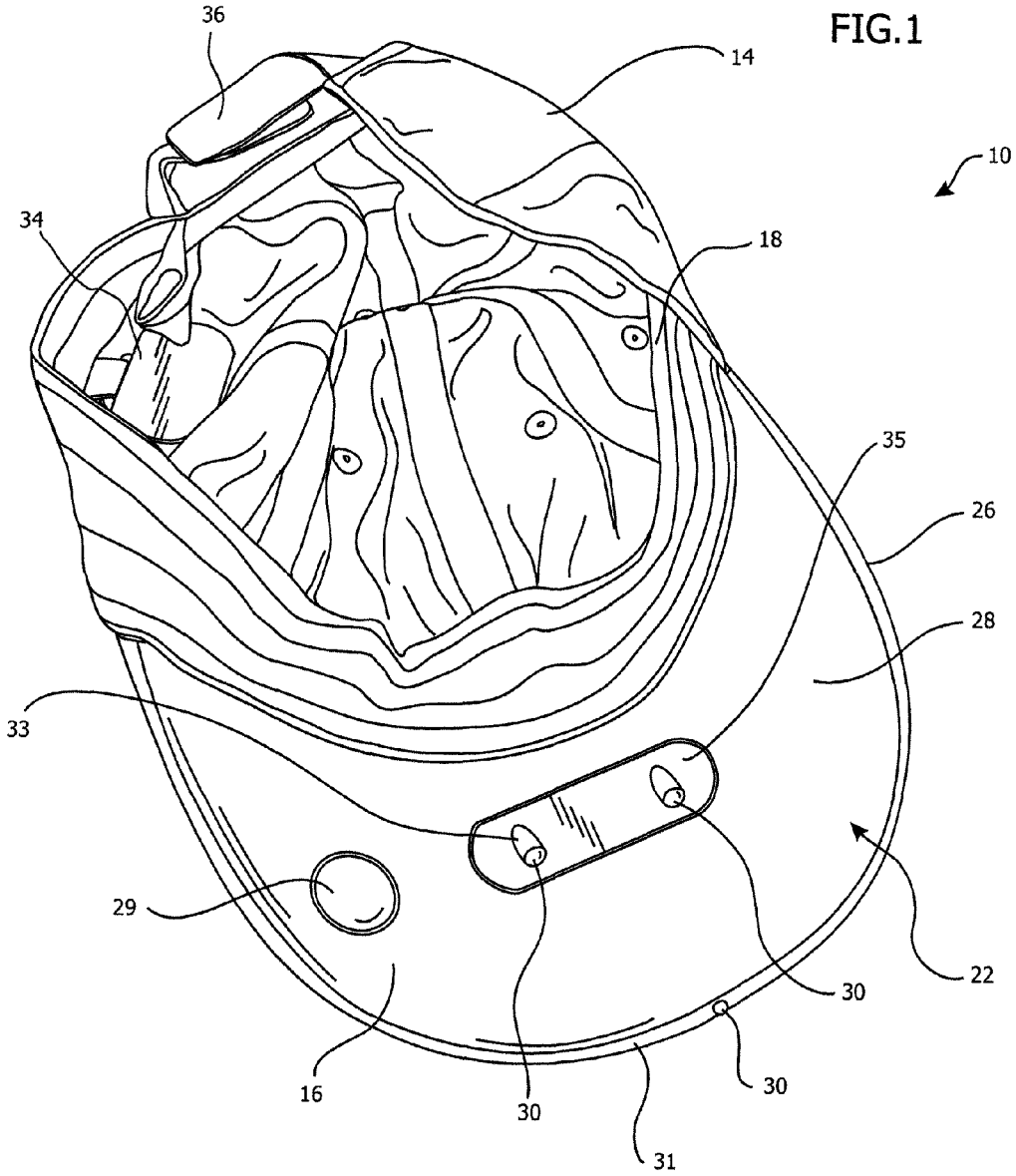
FIG. 1 is a perspective view of a hat showing light sources mounted to a brim of the hat, a switch indicator portion incorporated in lower covering material of the brim, and a power source mounted to a crown of the hat.
Figure 2:
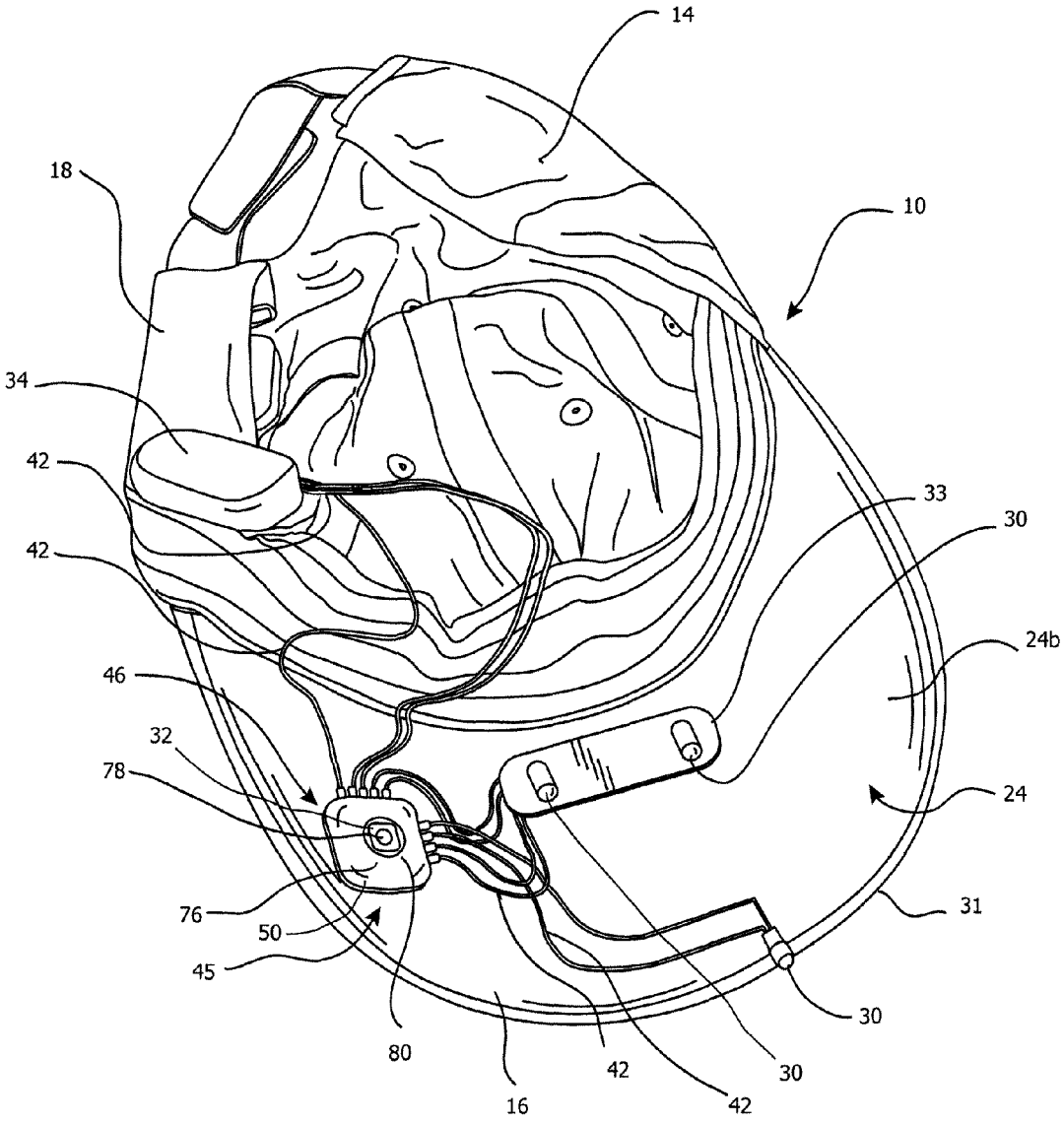
FIG. 2 is a bottom view of the hat with the brim lower covering material removed showing a brim insert, and a shut-off mechanism electrically coupled to the light sources and the power source.

Referring now to FIGS. 1 and 2, a hat 10 includes one or more electronic devices 12, including, for example, one or more light sources 30, a camera device, audio devices, or the like, that offer hands-free operation due to mounting to the hat 10. The hat 10 is illustrated as a baseball-type cap having a head-fitting portion, such as a crown portion 14, for fitting on a wearer's head and a support structure, such as a brim portion 16, projecting forwardly from a lower, forward edge portion of the crown portion 14. The crown portion 14 can include fabric material, such as segmented portions, that fit together to form the dome shape thereof. Partially rigid or shape retentive members can be utilized to hold the dome shape of the crown. Alternatively, the crown portion 14 can be rigid or have an annular configuration, such as with visors or the like. The crown portion 14 can also include an inner band 18 around a lower bottom edge portion thereof. The band 18 can be of material that is elastic to closely conform the crown portion 14 to a user's head and/or have wicking characteristics to wick sweat away from a user's head.

The brim portion 16 has upper and lower main surfaces 20 and 22. The brim portion 16 includes a shape-retentive insert 24, such as of a foam or plastic material that is resiliently flexible so it can maintain a desired configuration for the brim portion 16, which can include a lateral curvature. The shape-retentive insert 24 includes upper and lower surfaces 24*a* and 24*b*. The brim portion 16 can also include an upper covering 26 and lower covering 28 that extend over the corresponding surfaces 24*a* and 24*b* of the insert 24, such as of a plastic, fabric, or other material. In such a form, the coverings 26, 28 would form the upper and lower main brim surfaces 20, 22 thereon. Alternatively, if the coverings 26 and 28 are omitted so that the insert 24 is exposed and is the brim portion 16, then the insert upper and lower surfaces 24*a* and 24*b*, would be the upper and lower main brim surfaces 20 and 22. The lower covering 28 can include a switch indicator portion 29 configured to provide a visual and/or tactile indication of where an on/off switch 32, described in more detail below, is located on the brim portion 16. Alternatively, the switch 32 can be mounted to the crown portion 14. The switch indicator 29 can be an embroidered portion, densely packed stitching, plastic, rubber, or other materials mounted to the brim portion 16 that appear different than the remainder of the lower covering 28 so as to provide the user with a visual indication of where the light switch device 32, and specifically the actuator 78 thereof, is located.

The light sources 30 can be mounted to an outer peripheral edge 31 of the brim portion 16 or along one or both of the upper and lower main brim surfaces, 20 and 22, such as to the coverings 26 and 28 and/or the surfaces of the insert 24 therebetween. Alternatively, the light sources 30 can be mounted to the crown portion 14. In the illustrated form, a light source holder 33 having light holder or bezel portions extending about the light sources or LEDs to hold the light sources at a desired angle is mounted to the brim portion 16, such as to the lower covering 28 thereof so that the light holders project through openings in the covering 28. The lower covering 28 can include an embroidered or densely packed stitching portion 35 having the openings therein for the light holder portions. Example light holder and light source configurations are described in U.S. patent application Ser. No. 12/714,403, filed Feb. 26, 2010, which is hereby incorporated by reference herein in its entirety.

A power source 34 is mounted or attached to the hat 10 to provide power to the electronic devices 12. The power source 34 can be replaceable, such as coin cell batteries, AA batteries, AAA batteries, or the like, or can be rechargeable. More specifically, the power source 34 can be coupled to the hat crown 14, such as to the hat band 18 or an adjustment strap 36 at the rear thereof. Alternatively, the power source 34 can be mounted to the brim portion 16 or at least partially embedded therein.

The hat 10 can also include an on/off switch device 32 having an actuator 78 such as in the form of a push button, slide switch, rotary switch, or the like, operable to cycle the electronic devices 12 between on and off conditions. The on/off switch device 32 can be mounted to the crown portion 14 or the brim portion 16, such as along or adjacent one of the upper and lower main surfaces 20 and 22 thereof. Preferably, the switch device 32 is mounted to the lower surface 24*b* of the brim insert 24 underneath the lower covering 28, so that a wearer of the hat 10 has to actuate the switch device 32 through contact with the lower covering 28. This maintains the natural appearance of the hat 10 by concealing the switch device 32 from view under the brim portion 16.

Figure 7:
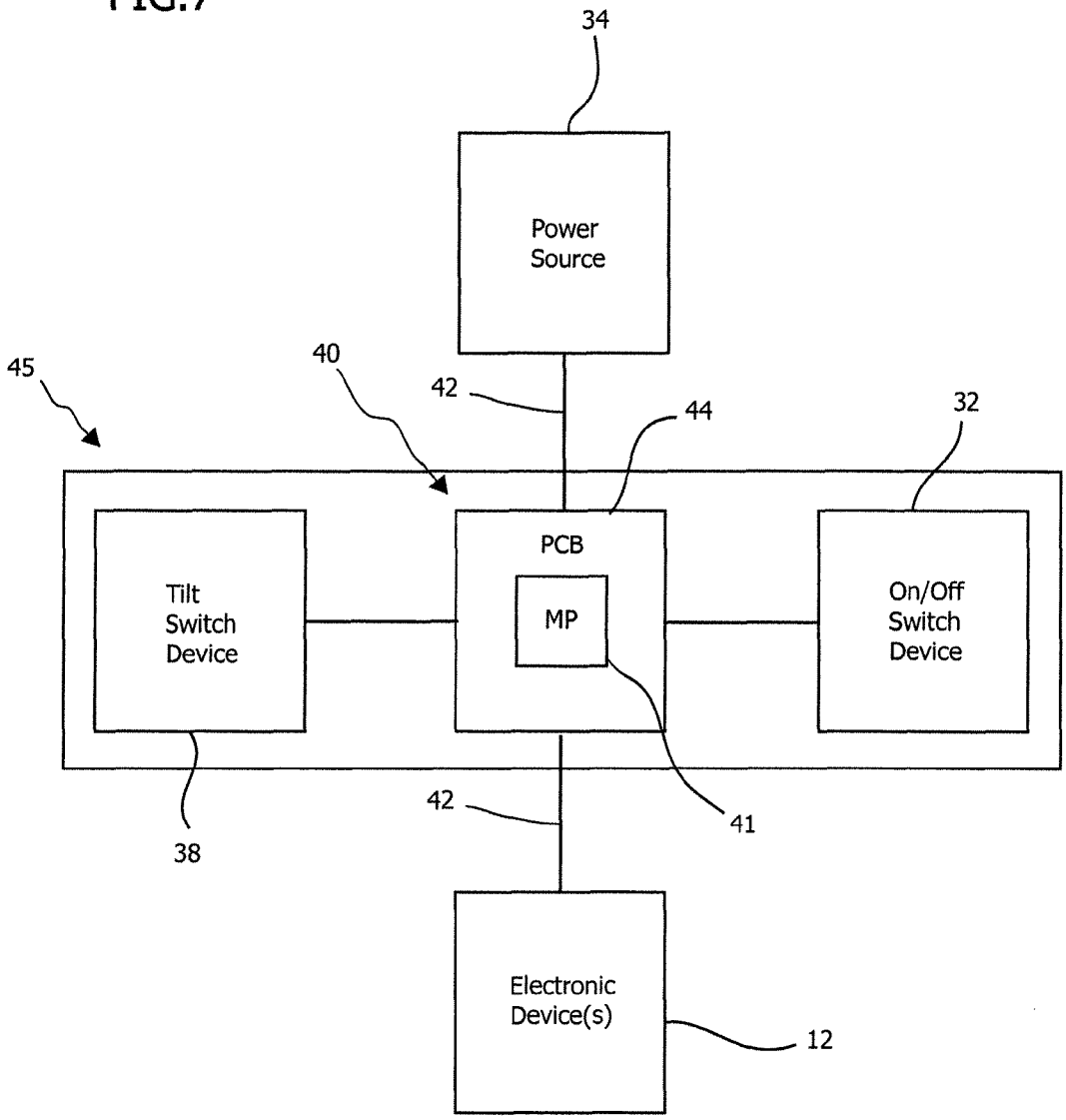
FIG. 7 is a diagram of electronic components of the electrical system including electronic device(s) electrically coupled to a power source and an automatic shut-off mechanism for controlling power supplied to the electronic device (s)

As described above, to preserve life of the power source 34, the hat 10 also includes a motion or inertia sensor such as a tilt switch device 38 and control circuitry 40 therefor, which can include electrical components such as a circuit board 44 with electrical devices mounted thereto including a microchip or microprocessor 41 or the like, with the control circuitry 40 being configured to provide timed operation of the electronic device(s) 12. In order to electrically connect the various electrical components and devices, electrical connections, including wires 42, traces on a circuit board 44, and the like, can be provided and electrically connect the electrical devices 12, the power source 34, the on/off switch 32, the tilt switch device 38, as well as the electrical devices on the circuit board 44 including the microprocessor 41. Preferably, as shown in FIG. 7, the microprocessor 41, the on/off switch 32, and the tilt switch device 38 are electrically coupled to the circuit board 44 to form an automatic shut-off mechanism 45, and this automatic shut-off mechanism 45 is electrically coupled to the electronic devices 12 and the power source 34 with the leads or wires 42. The automatic shut-off mechanism 45 of the microprocessor 41, the on/off switch 32, and the tilt switch 38 can be mounted to the lower surface of the brim insert 24 or the lower covering 28 using a suitable adhesive or the like, and the wires 42 can also be adhered to the brim insert 24 with spots of a suitable adhesive or received within a recessed channel or channels formed in the brim insert 24. Alternatively, the automatic shut-off mechanism can be mounted to the crown portion 14, such as to the hat band 18 or coupled to the power source housing. Additionally, the automatic shut-off mechanism 45 can be utilized in other applications such as flashlights, headlamps (wherein the support structure is the headlamp housing), lighted glasses (such as those disclosed in U.S. application Ser. Nos. 12/895,456, filed Sep. 30, 2010, 12/835,508, filed Jul. 13, 2010, 13/025,100, filed Feb. 10, 2011, and 13/103,971, filed May, 9, 2011, which are all incorporated by reference herein in their entirety), wireless communication devices, such as phones or tablets, to turn off the respective electronic components, such as light sources, when the devices are left operating in a fixed position.

Figure 10:
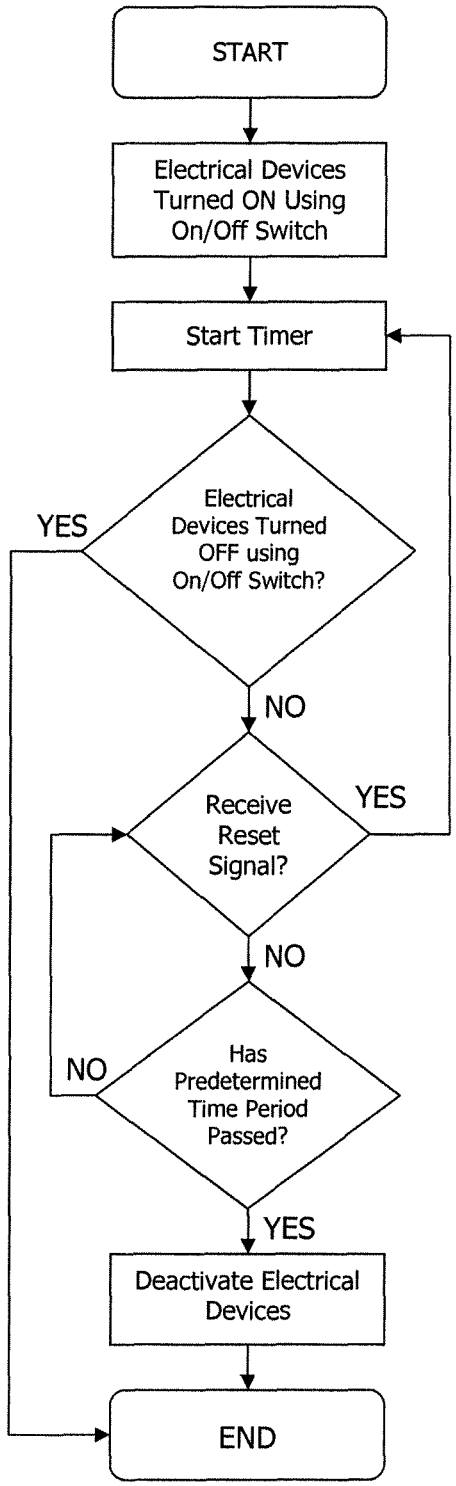
FIG. 10 is a flowchart showing operation of the electronic components of FIG. 6.

As shown in FIG. 10, upon activation of the electrical device(s) 12, the control circuitry 40 is configured to start a shut-off timer, which can correspond to a predetermined number of cycles of the microprocessor 41 or a separate clock electronic component mounted to the circuit board 44, set at a predetermined time period, such as about 5, 10, 15 minutes or the like. The control circuitry 40 is configured to turn the electronic devices 12 off after the predetermined time period has lapsed. The tilt switch device 38, however, advantageously is configured to reset the shut-off timer, and the predetermined time period, upon receiving a reset signal generated by movement of the hat 10, so that the electronic devices 12 do not undesirably turn off while a user is wearing the hat 10, but advantageously turn off if a wearer of the hat 10 takes the hat off, forgets to turn off the electronic devices 12, and places the hat 10 in a stable orientation. The operation of the tilt switch device 38 in relation to the other electrical components of the hat 10 is discussed in more detail below. A user can also deactivate the electrical device(s) using the on/off switch 32.

Preferably, the automatic shut-off mechanism 45 including the circuit board 44 with the control circuitry 40, the on/off switch 32, and the tilt switch 38 mounted thereto is received within a housing 46. As shown, the housing 46 includes a base 48 and a cover 50 that are connected as by being snap fit together with the automatic shut-off mechanism 45 therebetween. The circuit board 44 can include apertures 52 that are sized to receive shafts 54 extending from the cover 50 therethrough. The shafts 54 fix the circuit board 44 against lateral movement when the circuit board 44 is received in the housing 46. Preferably, the base 48 includes bores 56 sized to receive the shafts 54 of the cover 50 therein so that the cover 50 and the base 48 can be connected together with the circuit board 44 therebetween. Alternatively, shafts 54 can project from the base 48 to be received within corresponding bores in the cover.

Figure 5:
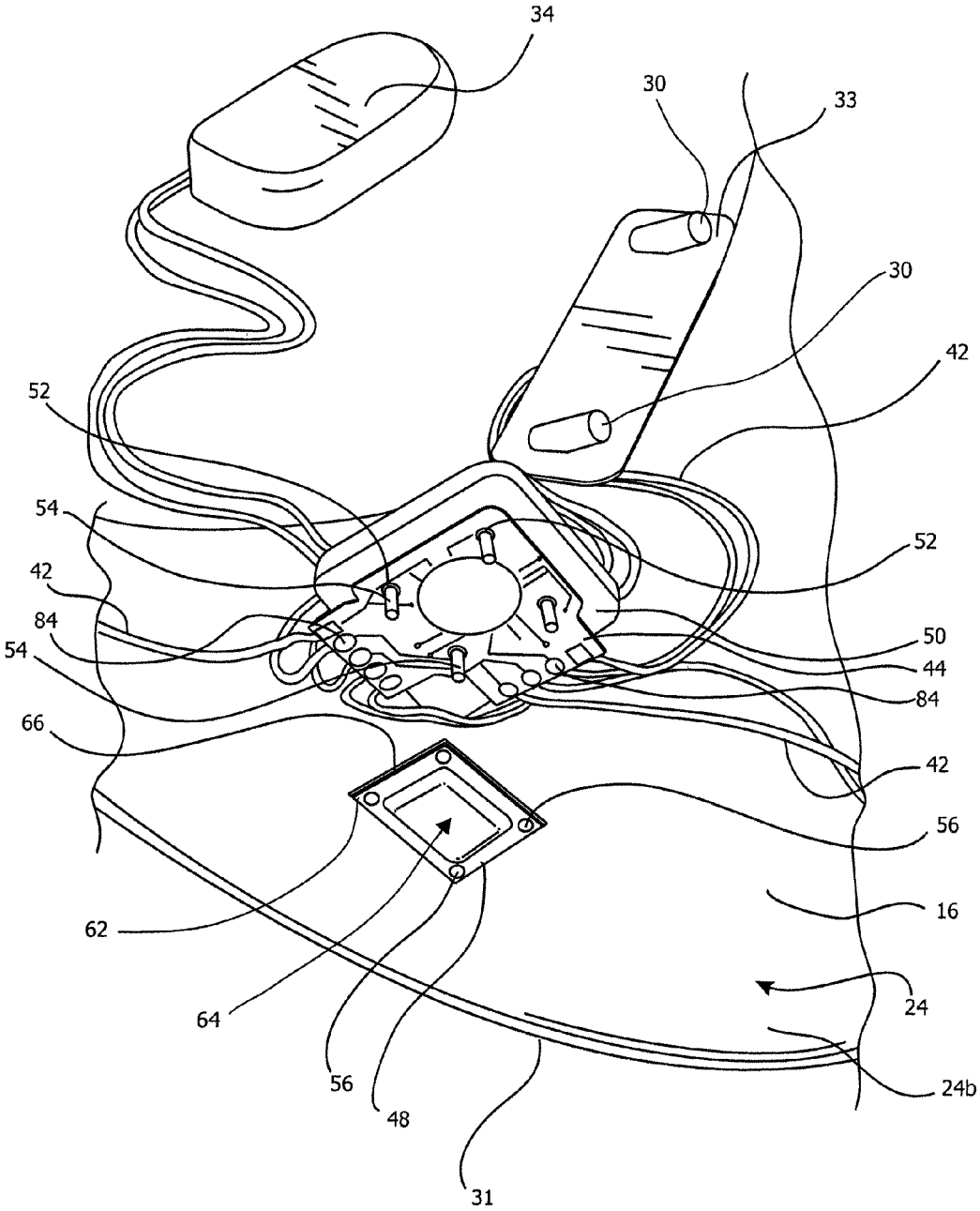
FIG. 5 is a perspective view of the brim insert showing a base and a cover of a housing for the shut-off mechanism with the shut-off mechanism coupled to the housing cover and the base of the housing received within an opening in the brim insert.
Figure 6:
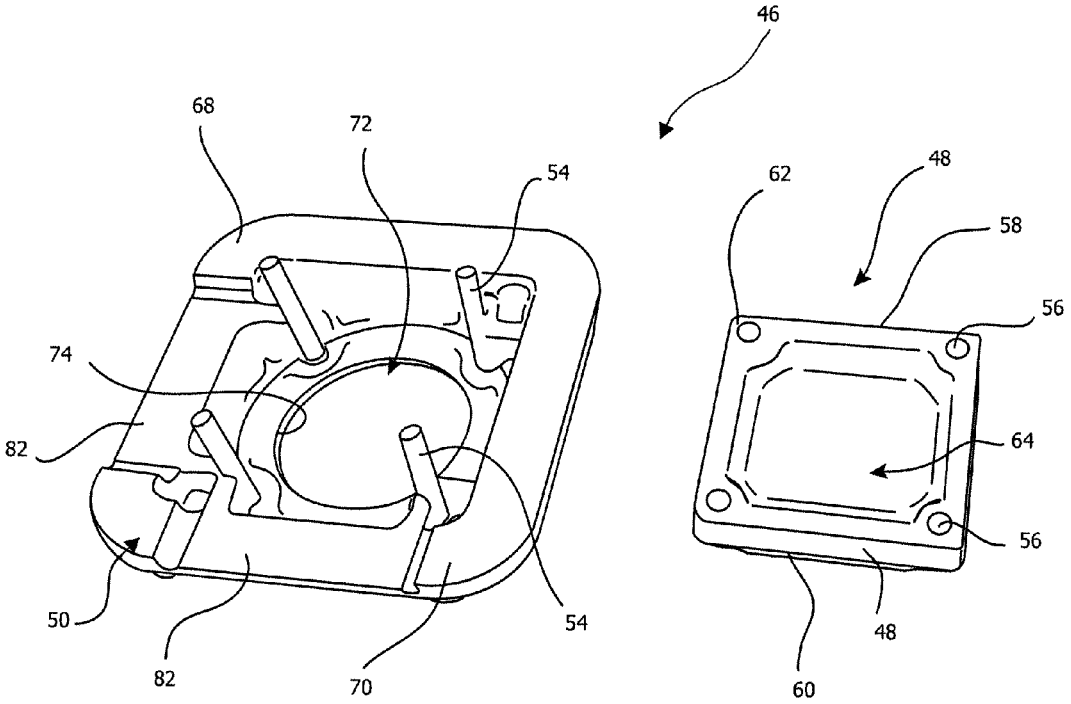
FIG. 6 is a perspective view of the housing for the automatic shut-off mechanism showing the cover and the base thereof.

Turning now to more details of the housing 46 as shown in FIGS. 5 and 6. The base 48 has a generally rectangular, and preferably square, footprint or perimeter 58 with four edges 60 joined at corners 62. An interior area 64 of the base 48 can be recessed for reception of circuit board 44 components when the housing 46 is assembled. As such, the bores 56 can be positioned at the corners 62 to maximize the interior area 64. The brim insert 24 can include a recess or opening 66 therein sized to receive the base 48 so that only the cover 50 of the housing 46 projects beyond the lower surface 24*b* of the brim insert 24 for maintaining the streamlined appearance of the hat 10.

The cover 50 also has a generally rectangular, and preferably square, footprint or perimeter 68. As shown, the cover's footprint 68 is larger than the base's footprint 58. As such, the cover 50 includes an outer edge or flange portion 70 that projects outwardly beyond the perimeter 58 of the base 48 with the base 48 and cover 50 connected together. This outer flange portion 70 can be utilized to secure the cover 50 to the lower surface 24*b* of the brim insert 24 using a suitable adhesive or the like with the base 48 received in the brim insert recess 66 to thereby secure the automatic shut-off mechanism 45 to the brim portion 16, and specifically to the brim insert 24 thereof.

Figure 11:
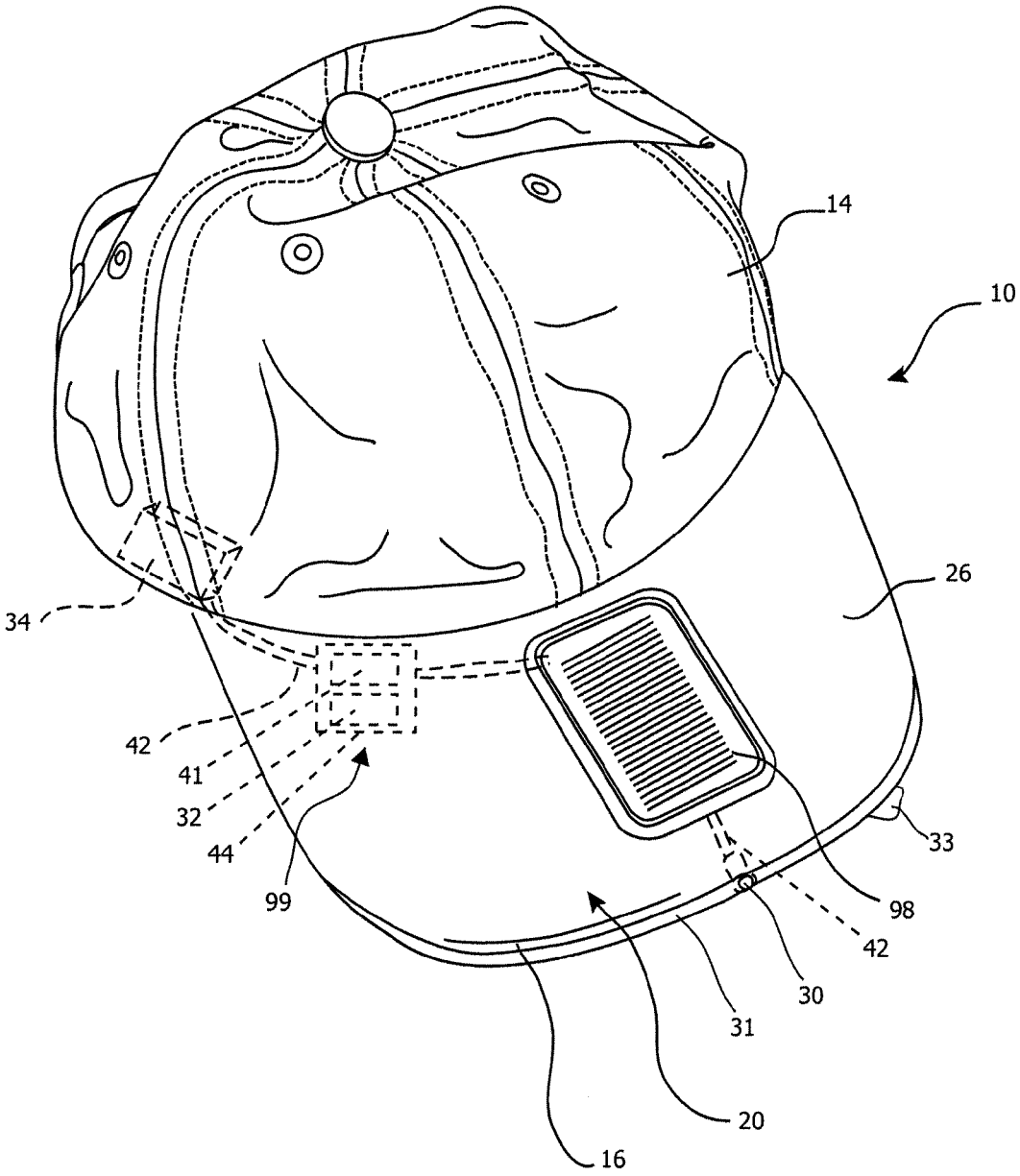
FIG. 11 is a perspective view of a hat having a solar panel mounted to a top surface of the brim portion thereof.

The cover 50 includes an interior recess 72 inwardly of the outer edge portion 70 for reception of the circuit board 44 and components mounted thereto, such as the microprocessor 41, tilt switch 38, on/off switch 32, as well as other typical circuit board electrical components. As shown in FIGS. 2 and 6, the cover 50 includes an upward facing opening 74 (which will be downwardly facing when mounted to the brim portion 16 with the hat in its normal upright orientation as shown in FIG. 11) in a top wall 76 thereof sized to receive a finger at least partially therethrough for actuation of the on/off switch 32 when the automatic shut-off mechanism 45 is received within the housing 46. Preferably, the actuator 78 of the on/off switch 32 is aligned with and recessed from the top wall 76 of the cover 50 so as not to project beyond the top wall 76. Alternatively, the actuator 78 can project past the top wall 76 and the actuator 78 has to be depressed past the top wall 76 for activation of the electronic devices 12. These switch device configurations minimize undesired actuation of the on/off switch 32 when the brim portion 16 is pressed against an adjacent surface, for instance when a stack of hats are shipped or when a hat is left on a table or the like. Specifically, cover 50 can include a generally frusto-conical portion 80 with the opening 74 at a top thereof. The frusto-conical portion 80 can extend around the on/off switch 32 to provide the protection against undesired actuation as discussed above.

The cover 50 can include one or more cut-out openings or channels 82 recessed to extend along and across the outer edge portion 70 thereof. The channels 82 form slot openings when the housing 46 is assembled to receive the wires 42 extending therethrough for connecting the power source 34 and the electronic devices 12 outside of the housing 46 to the automatic shut-off mechanism 45 in the housing 46. Alternatively, the channels 82 can be sized to receive projecting contact portions 84 of the circuit board 44 therethrough, which can then attach to the wires 42.

Figure 9:
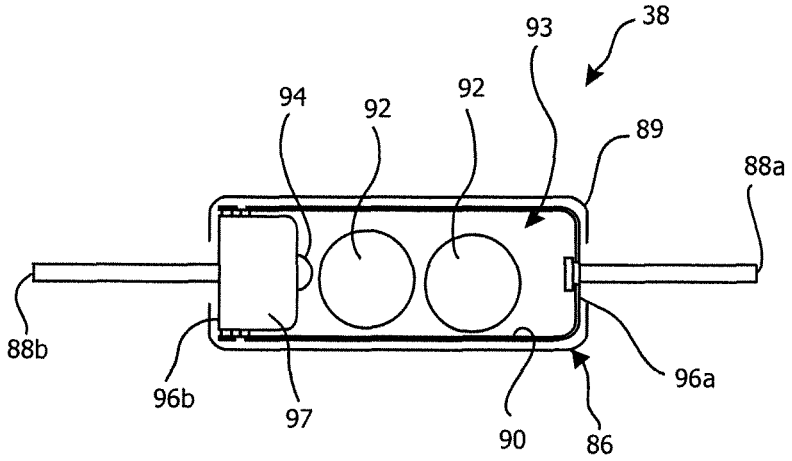
FIG. 9 is a cross-sectional view of the tilt switch device showing a tubular housing with contacts at opposite ends thereof and a pair of conductive balls for rolling therein.
Figure 8:
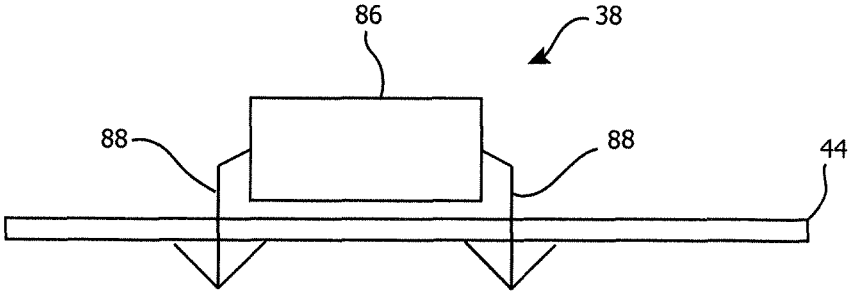
FIG. 8 is a front elevational view of a tilt switch device of the shut-off mechanism showing the device electrically coupled to a circuit board by leads thereof.

Referring now to FIGS. 8 and 9, the tilt switch device 38 is shown in more detail. Advantageously, the tilt switch device 38 has the operational characteristics of a mercury switch without the inherent risks thereof. The tilt switch 38 includes a housing 86 with a pair of leads 88 extending outwardly therefrom. The housing 86 can have shrink fit packaging 89 extending therearound to keep dust or other debris from impairing the operation of the tilt switch 38. The leads 88 electrically couple the housing 86 to the control circuitry 40. For this purpose, the leads 88 are connected to electrical paths and to the microprocessor 41 on the circuit board 44, and, through the circuit board 44, to the other electrical components of the hat 10.

Inside the housing 86 is a conductive tube 90 having opposing end portions 96*a* and 96*b* and being sized to receive one or more conductive balls 92, made of copper or the like, in the interior 93 thereof. In the illustrated form, the conductive tube 90 electrically connects to the lead 88*a* at the end portion 96*a* thereof. At the other end portion 96*b*, a contact 94 electrically coupled to the other lead 88*b* is exposed within the tube interior 93. The contact 94 at the end of the lead 88*b* is electrically insulated from the conductive tube 90 by an insulator member 97 fit in the tube interior 93 at the end 96*b* thereof and through which the lead 88*b* and/or contact 94 extends, as shown in FIG. 9. In this manner, the electrical circuit between the leads 88*a* and 88*b* is broken. The ball(s) 92 can freely travel within the interior 93 of the tube 90, such as by rolling on the inner surfaces of the tube 90, so that with movement of the tube 90, the ball 92, which is already in electrical engagement with the tube 90, will likely roll into contact with the contact 94 so that the ball 92 electrically couples the tube 90 and the contact 94, closing the circuit between the leads 88*a* and 88*b*. The engagement between the ball 92 and the contact 94 generates an electrical signal to the microprocessor 41 of the control circuitry 40 which is configured or programmed to reset the timer when the signal is received.

So configured, one of the leads 88*a* or 88*b* is electrically live through connection with the power source 34. In the illustrated example, lead 88*b* is live, so that when the ball 92 electrically couples the contact 94 and the tube 90, the electricity passes through the conductive ball 92 to the tube 90 and the lead 88*a* connected thereto, thereby electrically connecting the leads 88*a* or 88*b* and closing the electrical circuit, which causes voltage to be generated in a downstream electrical path which is used as a shut-off timer reset signal. In this manner, the tilt switch 38 can be configured to reset the shut-off timer by the timer reset signal generated upon the closing of the electrical circuit between the tube 90 and the contact 94 by the ball 92. The microprocessor 41 can be programmed to monitor the downstream electrical path from the tilt switch device 38 for a voltage, thereby receiving the reset signal and reset the shut-off timer every time the ball 92 electrically couples the tube 90 and the contact 94. Preferably, the timer will reset after the ball 92 electrically couples the tube 90 and the contact 94 and continue to run until the ball 92 disengages from the contact 94 and subsequently re-couples the tube 90 and the contact 94 by engaging the contact 94 again. This advantageously will deactivate any operating electrical devices mounted to the hat if the hat is left in a fixed orientation, but with the ball 92 electrically coupling the tube 90 and the contact 94 and staying in engagement with the contact 94, such as can occur when the hat is hung on a peg or the hat is resting on another object so that the tilt switch housing 86 is at an angled or other than horizontal orientation.

As shown, the contact 94 can be insulated from the tube 90 using a non-conductive plug member 97 sized to be received in the end portion 96 of the tube 90. The contact 94 can extend through the plug member 97 to electrically couple to the lead 88 and through the lead 88 to the circuit board 44. As such, the contact 94 is exposed in the interior 93 of the tube 90. Other configurations can also be utilized for the tilt switch. For example, two or more insulated contacts, as well as closed shapes other than a tube can be utilized. Additionally, a conductive fluid can be utilized in place of the ball 92.

Figure 3:
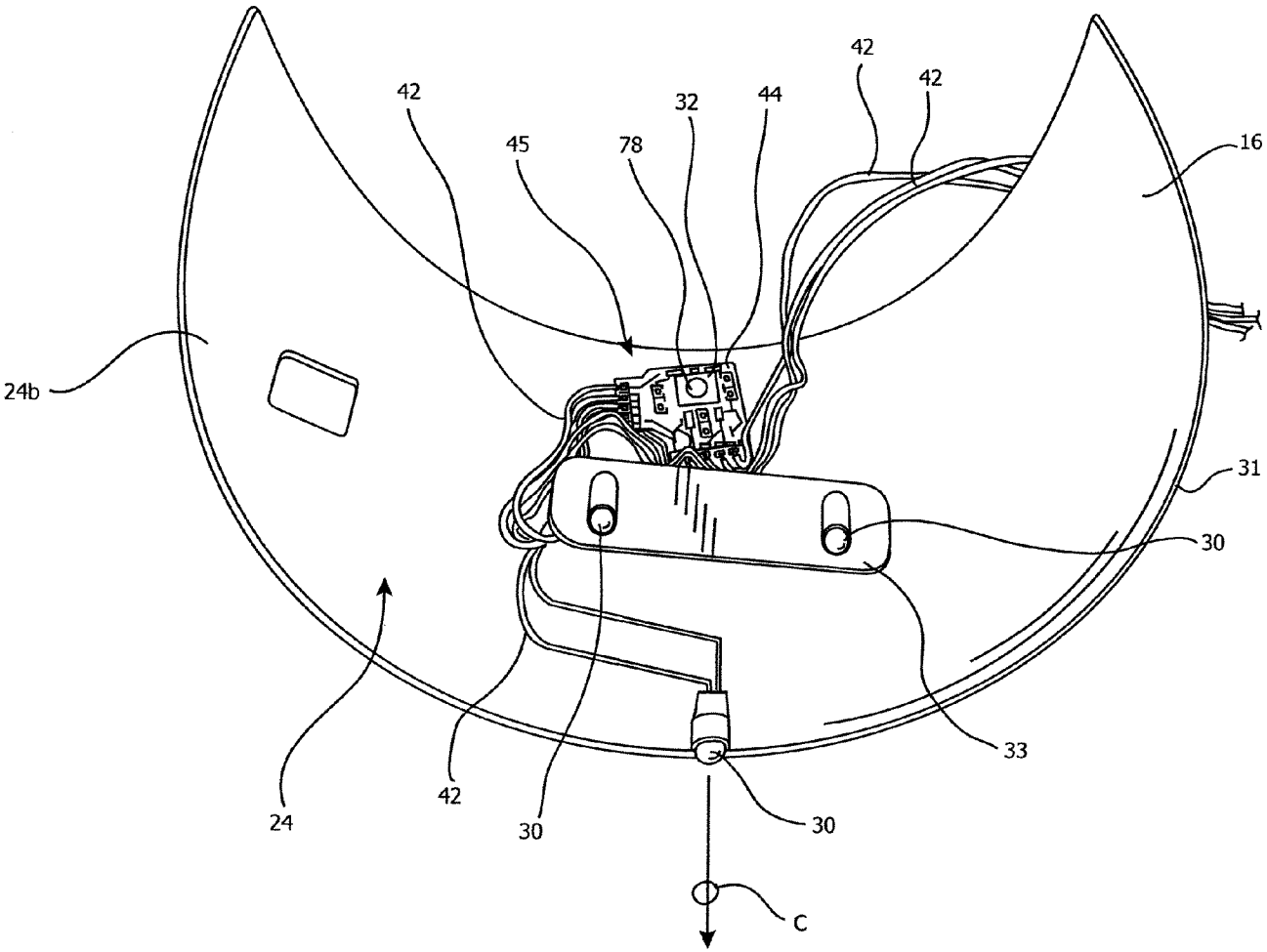
FIG. 3 is a perspective view of the brim insert showing an alternative location for the shut-off mechanism on the brim insert.
Figure 4:
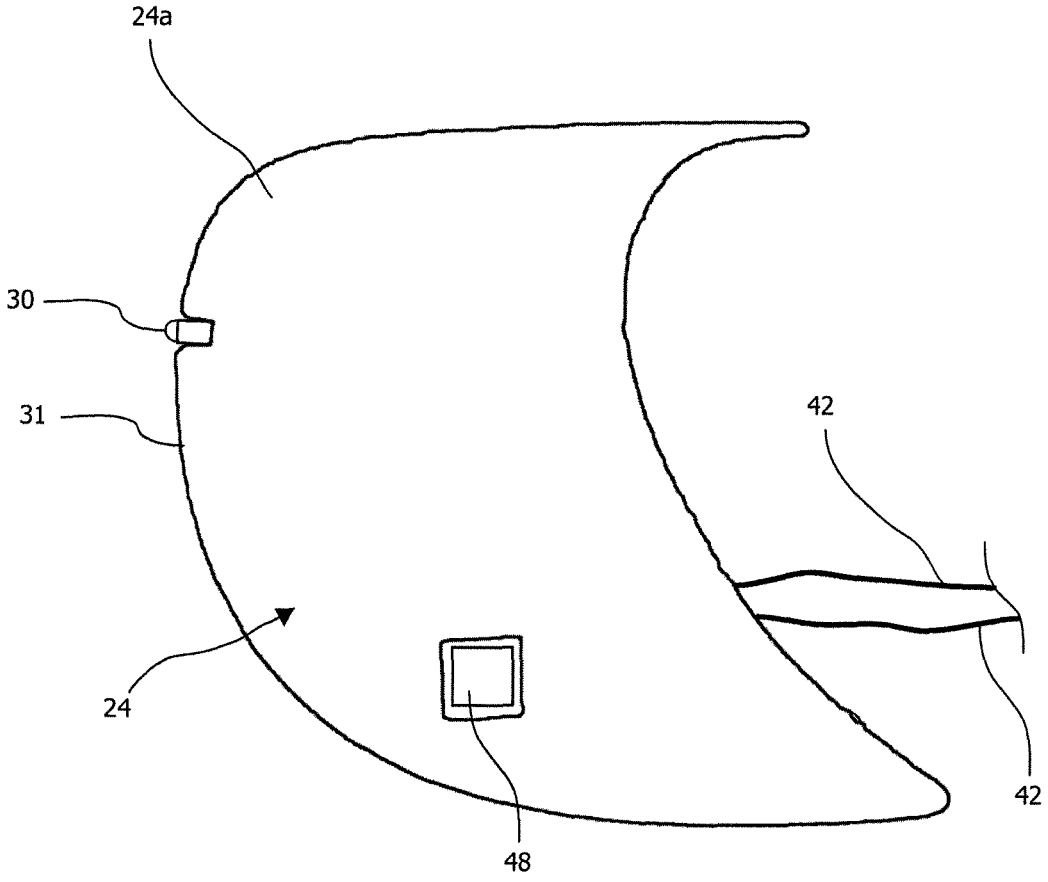
FIG. 4 is a perspective view of the brim insert showing the upper surface thereof and a base of a housing received within an opening in the brim insert.

Preferably, as shown in FIG. 3, the automatic shut-off mechanism 45 is mounted generally centrally on the brim portion 16, such as along a fore-and-aft axis C that extends from the crown 14 to the front of the brim portion 16 at a lateral center of the brim. So positioned, the tilt switch 38, and specifically the tube 90 thereof, will have a generally horizontal orientation when that hat 10 is worn in a normal orientation on a wearer's head despite any lateral curvature of the brim portion 16. This horizontal positioning provides the most opportunity for the ball 92 to roll upon movement of the hat and repeatedly electrically contact the contact 94 and maintain the operation of the electronic devices 12.

By another approach, the motion or inertia sensor can be in the form of an inertia switch or a whisker switch. With the whisker switch, a conductive whisker extends from a spring through an opening in a conductive surface. A circuit is created when the whisker contacts an edge of the opening. This provides a similar operation to the tilt switch 38 described above because normal movement while wearing a hat would cause the whisker to repeatedly contact the edge of the opening and therefore reset the shut-off timer.

Figure 12:
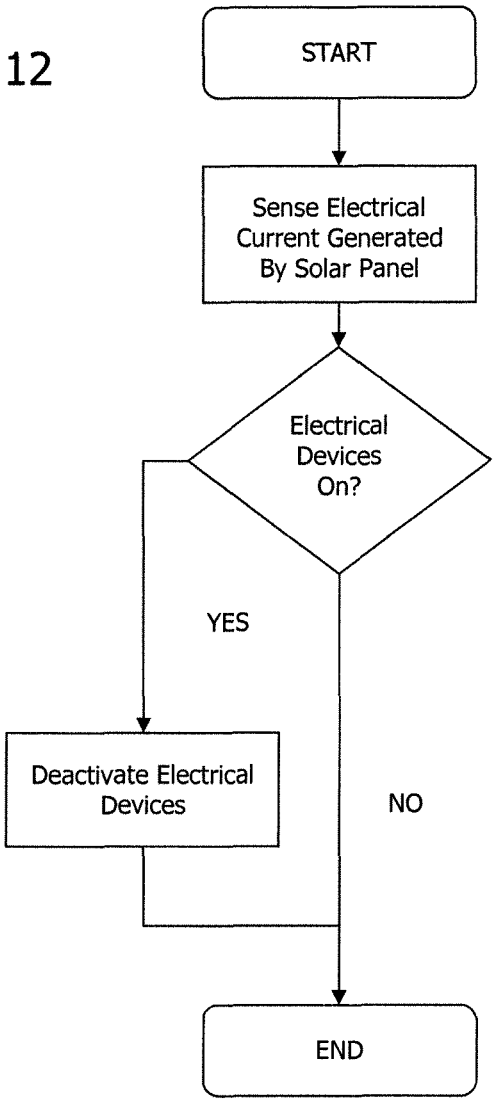
FIG. 12 is a flowchart showing operation of an automatic shut-off mechanism for electronic components electrically coupled to a power source charged by a solar panel.

As shown in FIGS. 11 and 12, another automatic shut-off mechanism 99 similar to the shut-off mechanism 45 discussed above can be utilized with a solar panel 98 mounted to the hat 10, such as the brim portion 16 or crown portion 14 thereof, and having a rechargeable power source 34. If the power source 34 needs to be charged and there is enough light for the solar panel 98 to generate electricity to charge the power source 34, then light generated by the light sources 30 mounted to the hat 10 is likely unnecessary. As such, the microprocessor 41 electrically coupled to the solar panel 98, the power source 34, and the light sources 30, such as by wires 42, traces on circuit boards 44, and the like, can be programmed to turn the light sources 30 off when it senses that the solar panel 98 is generating electricity. Specifically, the microprocessor 41 can monitor an electrical path from the solar panel for a voltage and be programmed or configured to turn any operating electrical devices 12, such as LED light 30, off in response to determining that the solar panel 98 is generating charging electricity for the power source 34.

It will be understood that various changes in the details, materials, and arrangements of the parts and components that have been described and illustrated in order to explain the nature of the lighted hats and garments as claimed may be made by those skilled in the art within the principle and scope of the invention.

The invention claimed is:

1. Headgear comprising:

a head fitting portion;

support structure extending forwardly from the head fitting portion;

one or more electronic device mounted to the support structure;

a power source mounted to one of the head fitting portion and the support structure for providing power to the one or more electronic devices;

a switch device mounted to one of the head fitting portion and the support structure and configured to cycle the one or more electronic devices between on and off states upon actuation thereof; and a motion sensing device mounted to one of the head fitting portion and the support structure and coupled between the power source and the one or more electronic devices;

wherein any of the one or more electronic devices in an on state are shut off in response to the motion sensing device not detecting motion for a predetermined period of time.

2. The headgear of claim 1 wherein the motion sensing device is a tilt switch device.

3. The headgear of claim 1 wherein the support structure comprises a brim portion having a brim insert with upper and lower coverings thereon; and the motion sensing device is mounted to the brim insert underneath one of the upper and lower coverings.

4. The headgear of claim 1 further comprising a switch guard configured to extend at least partially around the switch device to protect against inadvertent actuation.

5. Headgear comprising:

a head fitting portion;

support structure extending forwardly from the head fitting portion;

one or more electronic devices mounted to the support structure;

a power source mounted to one of the head fitting portion and the support structure for providing power to the one or more electronic devices;

a switch device mounted to one of the head fitting portion and the support structure and configured to cycle the one or more electronic devices between on and off states; and an automatic shut-off mechanism mounted to one of the head fitting portion and the support structure and comprising:

a motion sensing device configured to generate a reset signal in response to motion of the support structure;

a timer device configured to begin a timer of a predetermined period in response to activation of one of the one or more electronic devices and generate a shut-off signal in response to passage of the predetermined period without reset; and control circuitry configured to:

receive the reset signal from the motion sensing device and in response reset the timer of the timer device;

receive the shut-off signal from the timer device and in response turn off any of the electronic devices that are activated.

6. The headgear of claim 5 wherein the motion sensing device is a tilt switch device.

7. The headgear of claim 5 wherein the support structure is a brim portion.

8. The headgear of claim 7 wherein the switch device and the automatic shut-off mechanism are mounted to a circuit board.

9. The headgear of claim 8 wherein the circuit board is mounted adjacent to an underside of the brim portion.

10. The headgear of claim 8 further comprising a housing configured to receive the circuit board at least partially therein.

11. The headgear of claim 10 wherein the housing comprises a base portion and a cover portion having an opening therein to provide access to the switch device.

12. The headgear of claim 11 wherein the brim portion includes an opening therein to receive the base of the housing.

13. The headgear of claim 7 wherein the one or more electronic devices comprise one or more light sources.

14. The headgear of claim 7 wherein the one or more electronic devices comprise a camera device.

15. The headgear of claim 7 wherein the brim portion comprises a brim insert having upper and lower coverings thereon; and the switch device and the automatic shut-off feature are mounted to the brim insert underneath one of the upper and lower coverings.

16. The headgear of claim 15 wherein head fitting portion comprises a crown portion; and the power source is received within a power source housing mounted to the crown portion.

17. The headgear of claim 7 further comprising a switch guard configured to extend at least partially around the switch device to protect against inadvertent actuation.

18. The headgear of claim 7 wherein the motion sensing device is mounted generally centrally on the brim portion.

19. The headgear of claim 5 wherein the support structure is a headlamp housing.

20. The headgear of claim 5 wherein the motion sensing device is an inertia switch.

* * * * *